US009022879B2

(12) United States Patent
Sato

(10) Patent No.: US 9,022,879 B2
(45) Date of Patent: May 5, 2015

(54) GOLF CLUB, SHAFT INSERTION DEPTH CHANGING METHOD AND SHAFT REPLACING METHOD

(71) Applicant: Bridgestone Sports Co., Ltd., Minato-ku, Tokyo (JP)

(72) Inventor: Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 85 days.

(21) Appl. No.: 13/969,775

(22) Filed: Aug. 19, 2013

(65) Prior Publication Data

US 2014/0051527 A1 Feb. 20, 2014

(30) Foreign Application Priority Data

Aug. 20, 2012 (JP) ..... 2012-181765

(51) Int. Cl.
*A63B 53/02* (2006.01)
*A63B 49/06* (2006.01)

(52) U.S. Cl.
CPC ..... *A63B 53/02* (2013.01); *A63B 2053/027* (2013.01); *A63B 2053/028* (2013.01); *A63B 49/06* (2013.01); *A63B 2053/022* (2013.01)

(58) Field of Classification Search
CPC ..... A63B 2053/027; A63B 2053/028; A63B 2053/022; A63B 53/02
USPC ..... 473/307, 308, 306, 305, 311
See application file for complete search history.

(56) References Cited

U.S. PATENT DOCUMENTS

| | | | | |
|---|---|---|---|---|
| 8,545,345 | B2 * | 10/2013 | Lo et al. | 473/307 |
| 2007/0078026 | A1 * | 4/2007 | Holt et al. | 473/305 |
| 2009/0286618 | A1 * | 11/2009 | Beach et al. | 473/307 |
| 2012/0316006 | A1 * | 12/2012 | Kitagawa et al. | 473/307 |
| 2013/0296068 | A1 * | 11/2013 | Sato | 473/307 |

FOREIGN PATENT DOCUMENTS

JP 2010213859 A 9/2010

* cited by examiner

*Primary Examiner* — Benjamin Layno
(74) *Attorney, Agent, or Firm* — Sughrue Mion, PLLC

(57) ABSTRACT

A golf club includes: a shaft; a head mounted on the leading end of the shaft; and a shaft case having a substantially cylindrical shape and fixed to the leading end of the shaft and inserted into a hosel formed in the head, the shaft case being fixed to the head by a bolt inserted from the sole side of the head, wherein the shaft case includes a small-diameter cylindrical portion on the leading end side thereof and a key portion formed on the outer peripheral surface of the small-diameter cylindrical portion, and multiple slits having different depths and engageable with the key portion are formed in the deep portion of the inside of the hosel, whereby, by changing the slits engageable with the key portion, the insertion depth of the shaft case into the hosel can be changed.

6 Claims, 12 Drawing Sheets

GOLF CLUB, SHAFT INSERTION DEPTH CHANGING METHOD AND SHAFT REPLACING METHOD

BACKGROUND

1. Field of the Invention

The present invention relates to a golf club and, specifically, it relates to a golf club capable of facilitating the replacement of a shaft. The invention also relates to a method for changing the insertion depth of the shaft of such golf club and a method for replacing such shaft.

2. Description of the Related Art

A golf club is constituted of a shaft and a head mounted on the leading end portion of the shaft, with a grip mounted on the base end side of the shaft.

In a conventionally ordinary golf club head, a hosel hole is formed directly in the head, and a shaft is inserted into the hosel hole and is fixed with adhesive. Here, as the adhesive, generally, there is used epoxy-system adhesive. In replacing the shaft, by heating the hosel portion of the head to destroy its texture constituted of epoxy resin hardened material, the shaft can be pulled out.

In such conventionally ordinary golf club head, the insertion depth of the shaft cannot be changed.

As a golf club capable of changing the insertion depth of a shaft case, in Japanese Patent Publication 2010-213859, there is disclosed a golf club in which a substantially cylindrical shaft case is fixed to the leading end of a shaft, the shaft case is inserted into the hosel of the head of the golf club from the upper end side of the hosel, and the shaft case is fixed to the hosel using first and second annular-shaped screw members removably threadedly mounted on the upper end side of the hosel.

In the golf club of the above-cited publication, a spacer is interposed between the lower end of the shaft case and the bottom portion of the hosel, the hosel includes a female screw formed in its inner peripheral surface on such upper end side, the first screw member is threadedly mounted on the upper end of the hosel coaxially with the hosel, the first screw member includes a female screw formed in its inner peripheral surface on the upper end side thereof, and the male screw of the second screw member is threadedly engaged with the female screw of the hosel. By removing the spacer and first screw member and threadedly mounting the second screw member onto the female screw of the hosel directly, the insertion depth of the shaft can be increased.

In the golf club of JP-A-2010-213859, in order to be able to adjust the shaft insertion depth in three or more stages, multiple sets of spacers and screw members are necessary, whereby the cost of the golf club parts is high.

SUMMARY

It is an object of the invention to provide a golf club capable of changing the insertion depth of a shaft using a simple structure, a method for changing the shaft insertion depth, and a method for replacing the shaft.

According to an aspect of the invention, there is provided a golf club, including: a shaft; a head mounted on the leading end of the shaft; and a shaft case having a substantially cylindrical shape and fixed to the leading end of the shaft and inserted into a hosel formed in the head, the shaft case being fixed to the head by a bolt inserted from the sole side of the head, wherein the shaft case includes a small-diameter cylindrical portion on the leading end side thereof and a key portion formed on the outer peripheral surface of the small-diameter cylindrical portion, and multiple slits having different depths and engageable with the key portion are formed in the deep portion of the inside of the hosel, whereby, by changing the slits engageable with the key portion, the insertion depth of the shaft case into the hosel can be changed.

According to the golf club of the invention, a spacer having the slits may be disposed in the deep portion of the inside of the hosel.

According to the golf club of the invention, a ferrule may be threadedly mounted on the upper end of the shaft case.

According to the golf club of the invention, the ferrule may include on the inner peripheral edge of the lower end thereof an annular projecting portion having an outside diameter decreasing as it goes downward, and the inner peripheral edge of the upper portion of the hosel may have a tapered shape engageable with the annular projecting portion.

According to another aspect of the invention, there is provided a method for changing the shaft insertion depth of the above golf club, including: removing the bolt; rotating the shaft case to bring the key portion into engagement with any one of other slits; and, thereafter, fixing the hosel by the bolt.

According to still another aspect of the invention, there is provided a method for replacing the shaft of the above golf club, including: previously fixing a new shaft to the same type of shaft case as the above shaft case to thereby prepare a new shaft-case/shaft connected body; removing a shaft-case/shaft connected body mounted on the golf club from the head of the golf club; and, mounting the new shaft-case/shaft connected body onto the same head.

Since the golf club of the invention is capable of adjusting the insertion depth of the shaft case into the hosel, in a golf club having the same head and the same shaft, by changing the insertion depth of the shaft case, a golf club length suitable for a player can be found out easily.

In the golf club of the invention, since the shaft case is inserted into the hosel hole and is fixed by the bolt inserted from the sole side of the head, the multiple annular screw members of JP-A-2010-213859 are not necessary and thus the cost of the parts of the golf club is reduced.

In the golf club of the invention, by engaging the key portion into any one of slits having different depths, the shaft insertion depth can be changed easily.

In the case that the tapered annular projecting portion of the ferrule is engaged with the tapered portion of the inner peripheral surface of the upper portion of the hosel hole, the ferrule and shaft case can be prevented against shaking.

According to the shaft replacing method of the invention, by loosening and removing the bolt, the shaft case can be taken out from the hosel. When a new shaft-case/shaft connected body, in which a shaft case is previously mounted on a shaft, is inserted into such hosel and the bolt is threadedly mounted thereon, the shaft can be replaced.

According to this method, it is possible to save such troublesome labor and time as in the prior art to heat and destroy the texture of adhesive to remove the shaft and then to mount a new shaft again with adhesive. Therefore, a shaft can be removed from the head of a golf club just put to a trial and another shaft having different properties can be mounted onto such head to give it a trial immediately. This makes it possible for a golfer to find out a suitable golf club quite easily in a golf shop or the like.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1A:
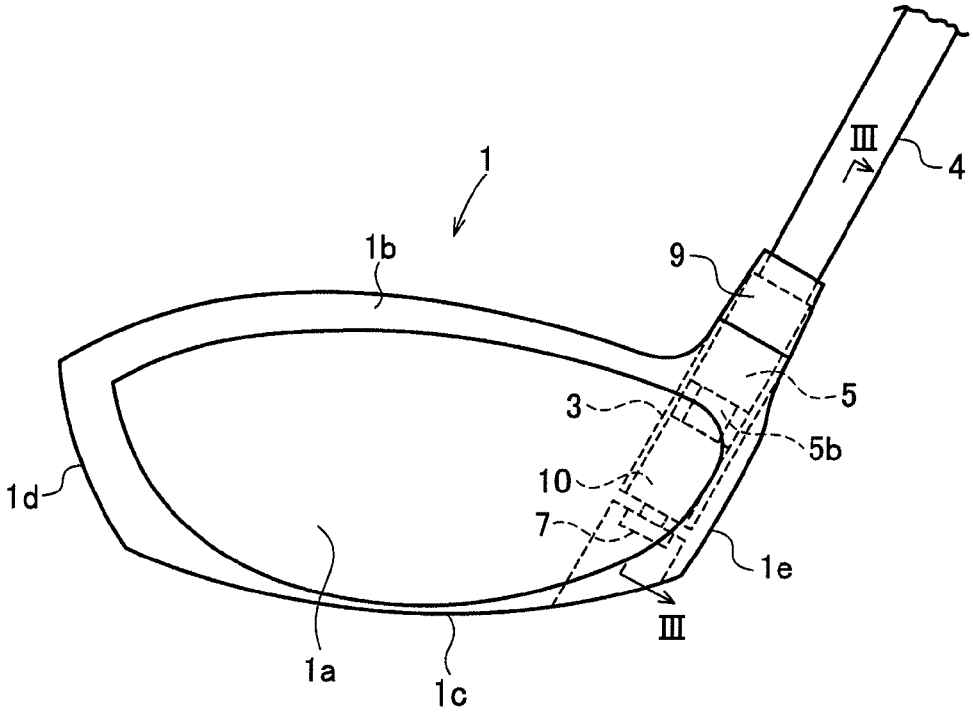
FIGS. 1A and 1B are front views of a head according to an embodiment of the invention.
Figure 1B:
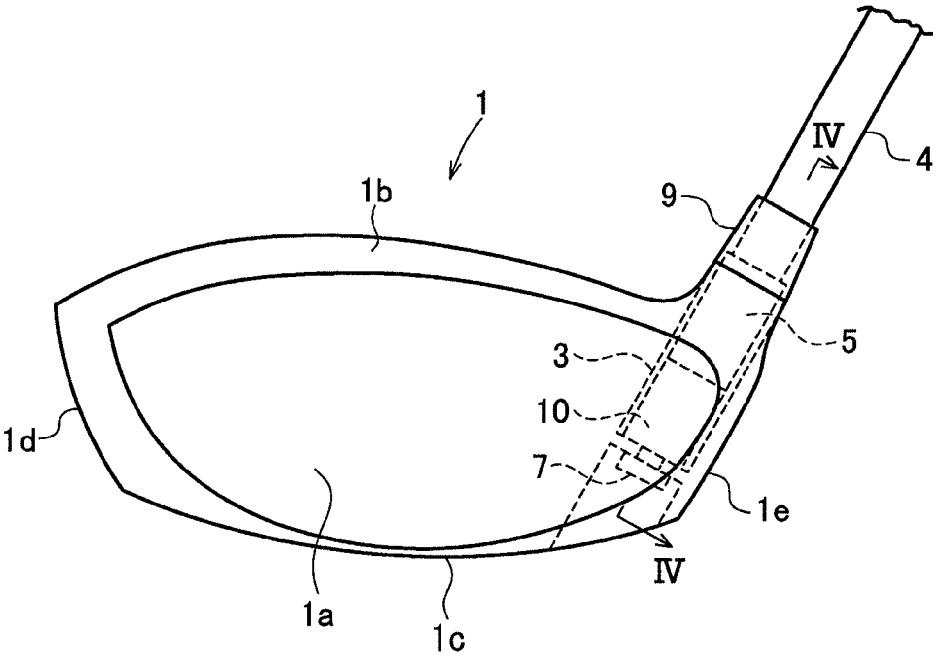
Figure 2:
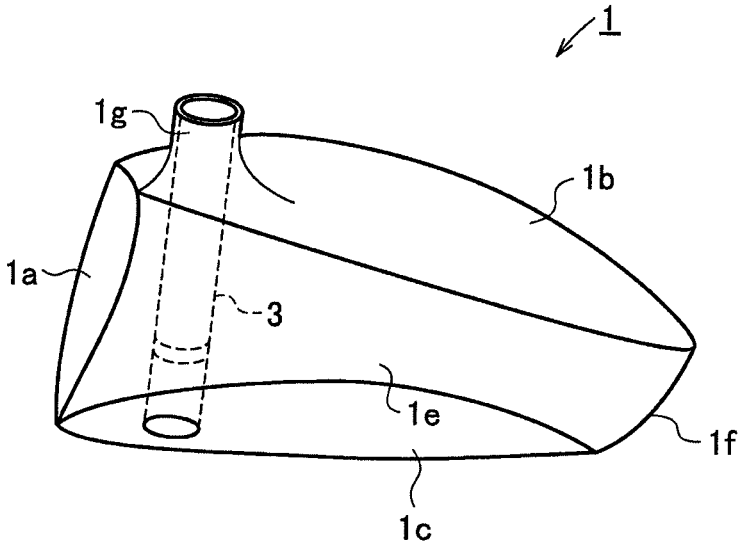
FIG. 2 is a side view of the heel side of the head.

Now, description is given below of embodiments of the invention with reference to the drawings.

Embodiment Shown in FIGS. 1 to 7

This golf club is structured such that a shaft 4 is mounted on the hosel 3 of a head 1 through a shaft case 5 and a bolt 7.

This head 1 is a hollow wood type head which includes a face portion 1*a*, a crown portion 1*b*, a sole portion 1*c*, a toe portion 1*d*, a heel portion 1*e* and a back portion 1*f*.

Figure 3:
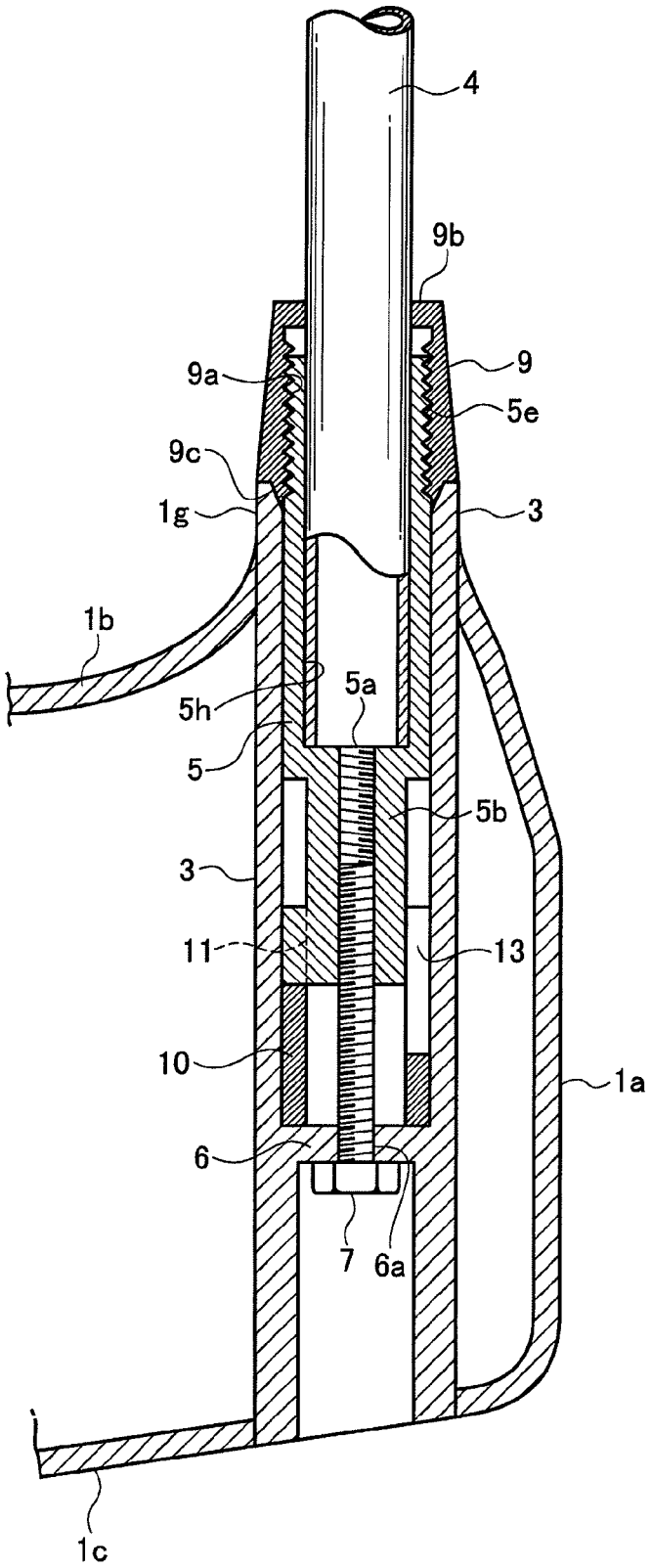
FIG. 3 is a section view taken along the III-III line shown in FIG. 1.

As shown in FIG. 3, the hosel 3 is disposed on the face portion 1*a* side and heel portion 1*e* side of the crown portion 1*b*. This hosel 3 has a cylindrical shape and extends up to the sole portion 1*c*. The shaft case 5 is inserted into the hosel 3 and is fixed by the bolt 7. A partition plate portion 6 extending perpendicularly to the axial direction of the cylindrical shape is provided near the sole portion 1*c* within the hosel 3, the bolt 7 is inserted through an opening 6*a* formed in the partition plate portion 6 and is screwed into the female screw hole 5*a* of the shaft case 5.

Figure 4:
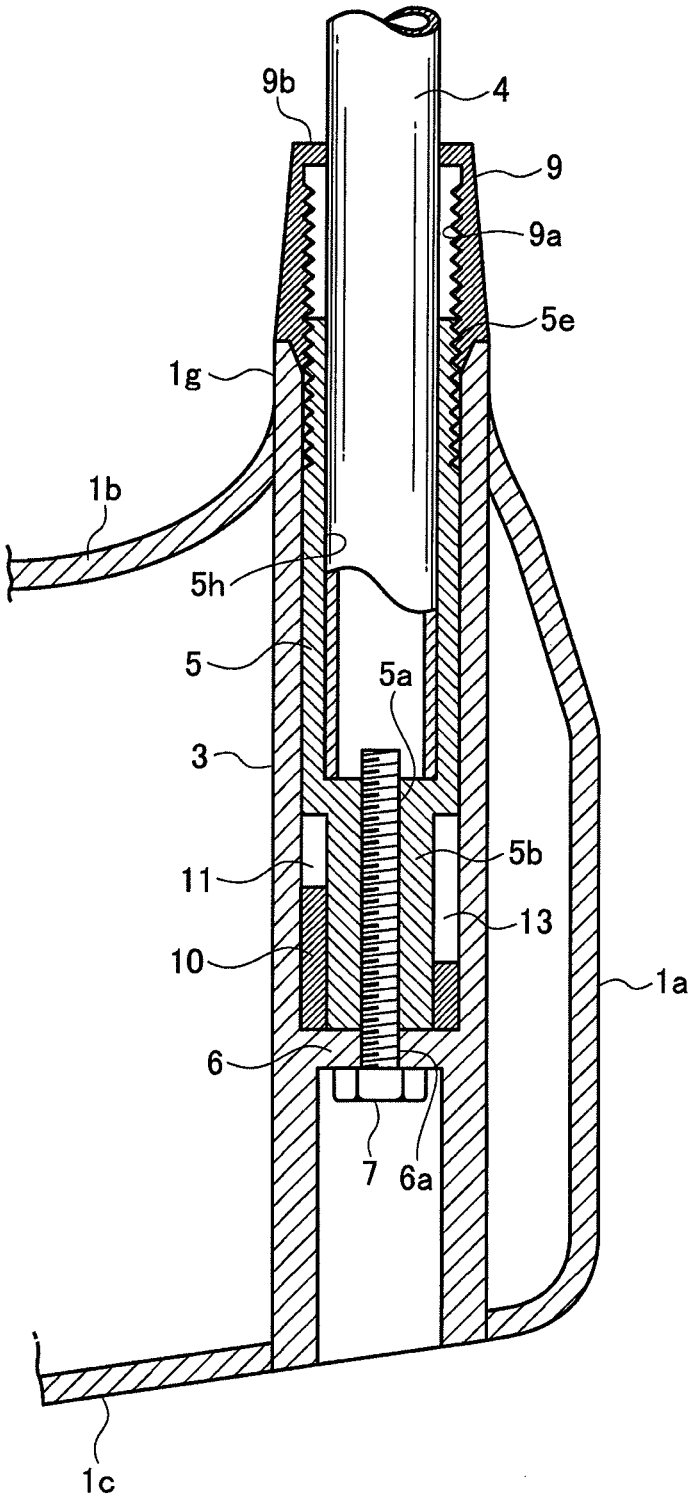
FIG. 4 is a section view taken along the IV-IV line shown in FIG. 1.
Figure 5:
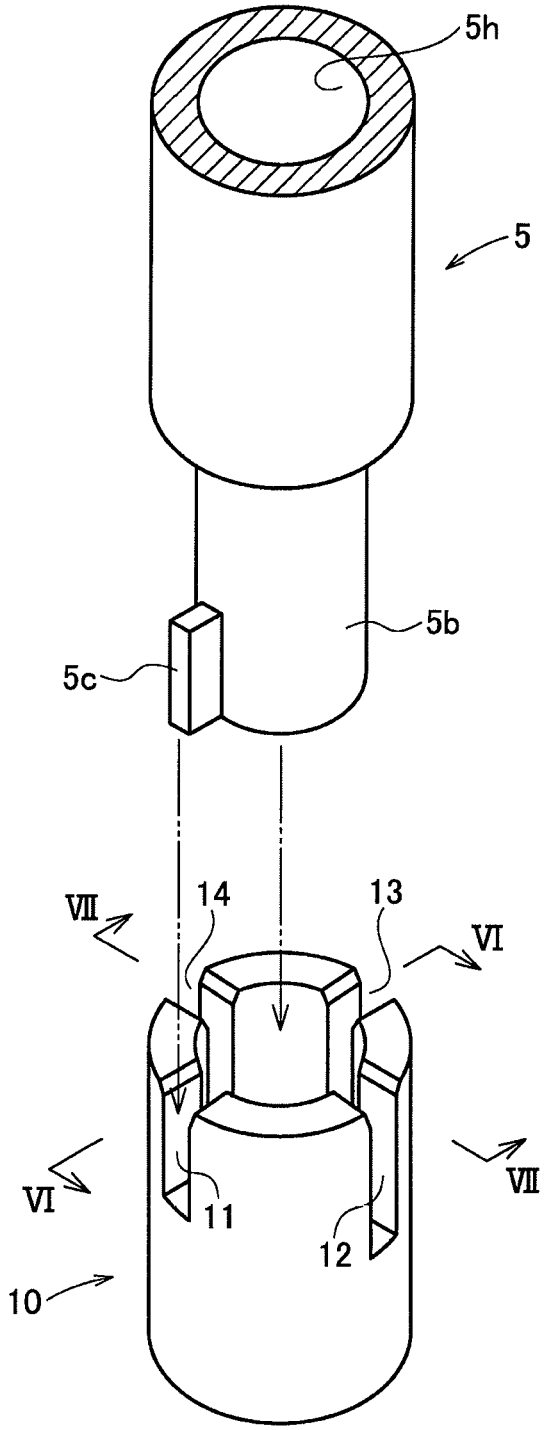
FIG. 5 is a perspective view of a spacer and the leading end side of a shaft case.
Figure 6:
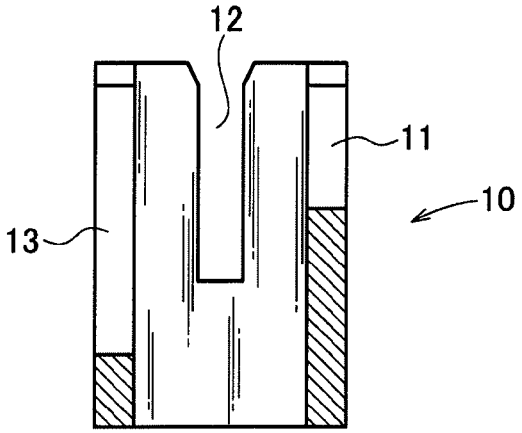
FIG. 6 is a section view taken along the VI-VI line shown in FIG. 5.
Figure 7:
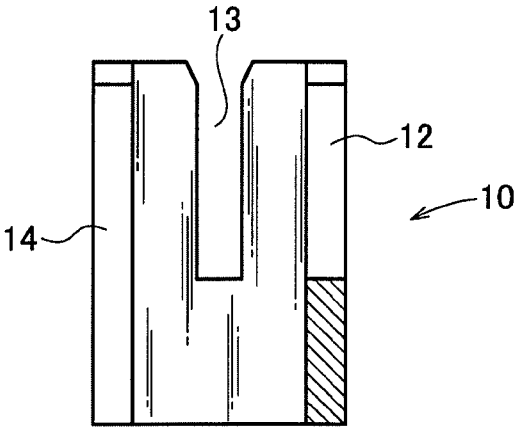
FIG. 7 is a section view taken along the VII-VII line shown in FIG. 5.

As shown in FIGS. 3 and 4, the shaft case 5 is a cylindrical member having a diameter slightly smaller than the hosel 3 and includes a hole 5*h* which extends from the upper end side of the shaft case 5 toward the lower end side thereof and into which the shaft 4 can be inserted. The shaft 4 is inserted into the hole 5*h* and is fixed to the shaft case 5 with adhesive. The depth of the hole 5*h* may preferably be 10 mm or larger, for example, 10-50 mm, especially preferably, about 20-40 mm. The female screw hole 5*a* is formed to penetrate from the deep bottom surface of the hole 5*h* to the lower end face of the shaft case 5.

The lower end portion of the shaft case 5 is formed as a small-diameter cylindrical portion 5*b*. The small-diameter cylindrical portion 5*b* has a diameter smaller than the portion of the shaft case 5 existing upwardly thereof.

A key portion 5*c* is provided on and projected from the outer peripheral surface of the lower-side small-diameter cylindrical portion 5*b*. The key portion 5*c* extends parallel to the cylindrical shape axial direction of the small-diameter cylindrical portion 5*b*.

A cylindrical spacer 10 is disposed on the deep section of the hosel portion 3. The spacer 10 is fixed to the hosel portion 3 by welding. However, it may also be previously formed integrally with the hosel portion by casting or the like.

The spacer 10 includes multiple slits formed to extend from the upper end face thereof parallel to the cylindrical shape axial direction. In this embodiment, four slits 11-14 are disposed at four equal positions in the peripheral direction of the spacer 10. The slits 11-14 are different in depth from each other, while the deepest slit 14 reaches the lower end of the spacer 10. The key portion 5*c* can be inserted into the slits 11-14. Here, the thickness of the key portion 5*c* (the width in the peripheral direction of the small-diameter cylindrical portion 5*b* shown in FIG. 5) is slightly smaller than the width of the respective slits 11-14. The upper end portions of the slits 11-14 respectively have a tapered shape the slit width of which increases as it goes upward, allowing the key portion 5*c* to be inserted into the respective slits 11-14 smoothly.

A male screw Se is formed on the outer peripheral surface of the upper portion of the shaft case 5. Upwardly of the hosel portion 3, there is provided a ferrule 9 in such a manner that it can be threadedly engaged with the male screw 5*e*. The ferrule 9 includes a female screw 9*a* formed in the inner peripheral surface thereof, while this female screw 9*a* is threadedly engaged with the male screw 5*e*.

The ferrule 9 has a tapered shape the diameter of which decreases as it approaches its upper end. An inwardly facing flange portion 9*b* is formed in the upper end portion of the ferrule 9.

The ferrule 9 includes an annular projecting portion 9*c* projected downwardly from the inner peripheral edge of the lower end portion thereof. This annular projecting portion 9*c* has a tapered shape the outside diameter of which decreases as it goes downward. The inner peripheral edge of the upper end face of the hosel portion 3 has a tapered shape the diameter of which increases as it goes upward, in order that it can be engaged with the annular projection portion 9*c*. When the ferrule 9 is screwed into the male screw 5*e*, the taper-shaped annular projecting portion 9*c* is pressed in the diameter reducing direction and is pressed against the outer peripheral surface of the shaft case 5, thereby preventing the ferrule 9 and shaft case 5 against shaking or the like.

To assemble the golf club, the shaft 4 may be bonded or fixed to the shaft case 5 through the ferrule 9; or, the ferrule 9 may be threadedly mounted onto the shaft case 5, the shaft 4 may be inserted into the shaft case 5 with the ferrule 9 mounted thereon and is fixed thereto using adhesive, thereby producing a shaft-case/shaft connected body. Preferably, the adhesive may be applied to the outer peripheral surface of the leading end portion of the shaft 4 and the shaft 4 may be then inserted into the deepest portion of the hole 5*h* of the shaft case 5.

Here, since the female screw hole 5*a* is formed in the shaft case 5, when the shaft 4 is inserted into the hole 5*h* of the case 5, air is allowed to flow out through the female screw hole 5*a*. As the adhesive, preferably, epoxy-system adhesive may be used.

The shaft case 5 of the shaft-case/shaft connected body, in a state where the female screw 9*a* of the ferrule 9 is not threadedly engaged or is slightly threadedly engaged with the male screw 5*e* of the shaft case 5, is inserted into the hosel 3. The key portion 5*c* is inserted into any one of the slits 11-14. The bolt 7 is screwed into the female screw hole 5*a* through the opening 6*a*. Next, the ferrule 9 is rotated and is pressed against the upper end face of the hosel portion 3.

Thus, as shown in FIGS. 3 and 4, the shaft case 5 is fixed to the head 1. Since the shaft case 5 and shaft 4 are firmly bonded to each other by the adhesive, there can be completed a golf club in which the shaft 4 and head 1 are connected as an integral body.

By removing and mounting the bolt 7 to change the slit to be engaged with the key portion 5*c*, the length of the golf club 1 can be changed. That is, when the key portion 5*c* is inserted into the slit 11, the length of the golf club 1 is shortest, or, when inserted into the slit 14, the length of the golf club 1 is longest. When the key portion 5*c* is inserted into the slit 12 or 13, the whole length of the golf club 1 provides a length between the shortest and longest lengths.

To replace the shaft of the golf club, the same type of shaft case as the shaft case 5 is previously fixed to a new replacing shaft with adhesive.

The bolt 7 of the existing golf club is removed and the old shaft 4 is removed together with the old shaft case 5 from the head 1. Next, a new shaft-case/shaft connected body with a ferrule 9 and a shaft case 5 is inserted into the hosel 3 and is fixed by the bolt 7.

In this manner, the shaft can be mounted or replaced very simply and quickly. Here, conventionally, in the shaft replacement, the hosel portion of the existing golf club is heated to destroy the texture of the hardened material of the adhesive and the old shaft is removed, and, after then, a new shaft is fixed with adhesive. Thus, the shaft replacement takes several hours to about one day. However, in this embodiment, by previously having mounted a new shaft case 5 using adhesive, the shaft replacement can be attained about several minutes. This makes it possible to realize a use system in which shaft-case mounted shafts of various types of specifications are previously prepared and thus, while mounting different shafts sequentially onto the same head 1, a user can put the golf club to a trial. Here, signs for indicating the positions of the slits 11-14 may also be given on the upper end face or upper outer peripheral surface of the hosel 3.

In this embodiment, in the spacer 10, the four slits 11-14 different in depth from each other are formed. However, 2 to 12 slits, especially, 3 to 8 slits may also be formed.

Figure 8:
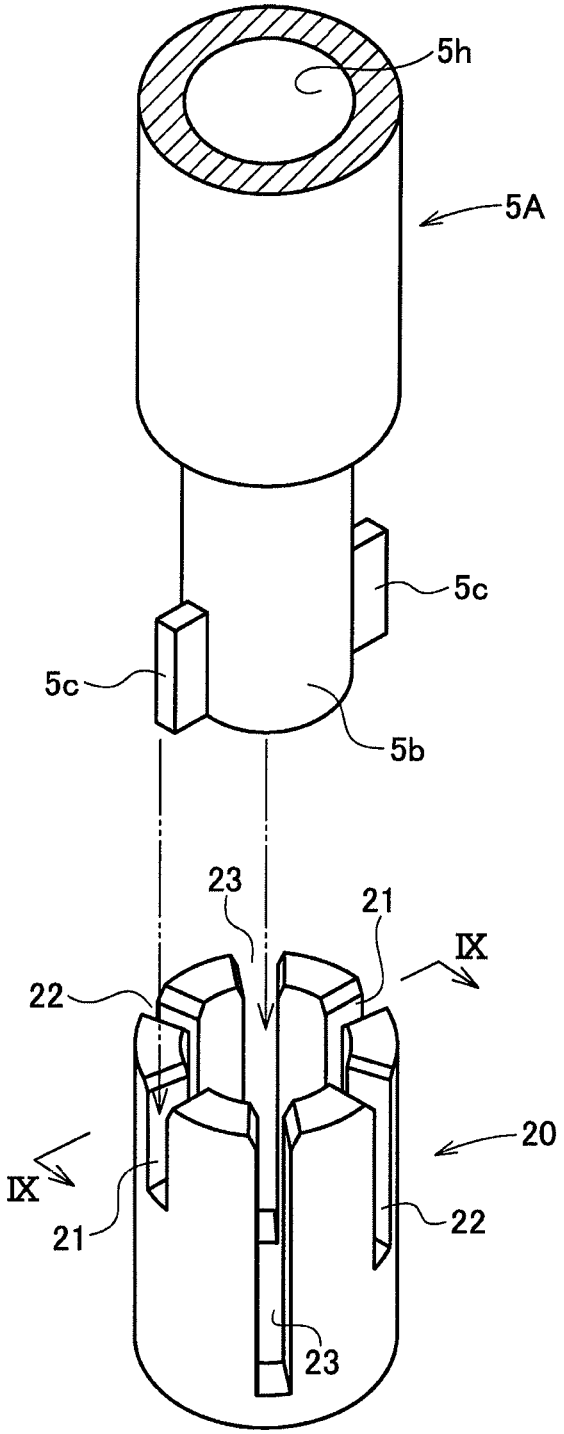
FIG. 8 is a perspective view of a spacer and the leading end side of a shaft case according to a second embodiment of the invention.
Figure 9:
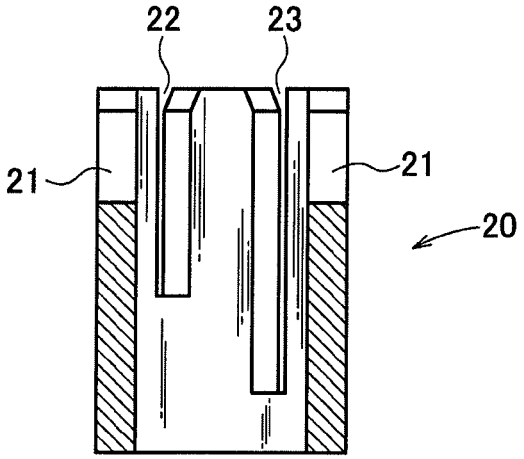
FIG. 9 is a section view taken along the IX-IX line shown in FIG. 8.

Embodiment in FIGS. 8 and 9

In the above embodiment, a single key portion 5*c* is formed in the small-diameter cylindrical portion 5*b*. However, like a shaft case 5A shown in FIG. 8, another key portion 5*c* may also be formed on the opposite side of the small-diameter cylindrical portion 5*b* in the diameter direction. In this case, as a spacer 20, there is used a spacer including a pair of equal-depth slits 21, 21, a pair of equal-depth slits 22, 22 and a pair of equal-depth slits 23, 23. The slits 21, 21 have the smallest depth, the slits 23, 23 have the largest depth, and the slits 22, 22 have an intermediate depth between the other pairs. In the case that two key portions 5*c* are formed in the small-diameter cylindrical portion 5*b*, the fixation strength of the shaft case 5A in the rotation direction is increased.

Although in FIGS. 8 and 9, three pairs (6 pieces) of slits 21-23 are formed, two pairs or four pairs of slits may also be formed. However, in the case that the number of slits is excessively large, there is a fear of the strength of the spacer being lowered. Therefore, preferably, the number of pairs may be 6 or smaller.

Figure 11:
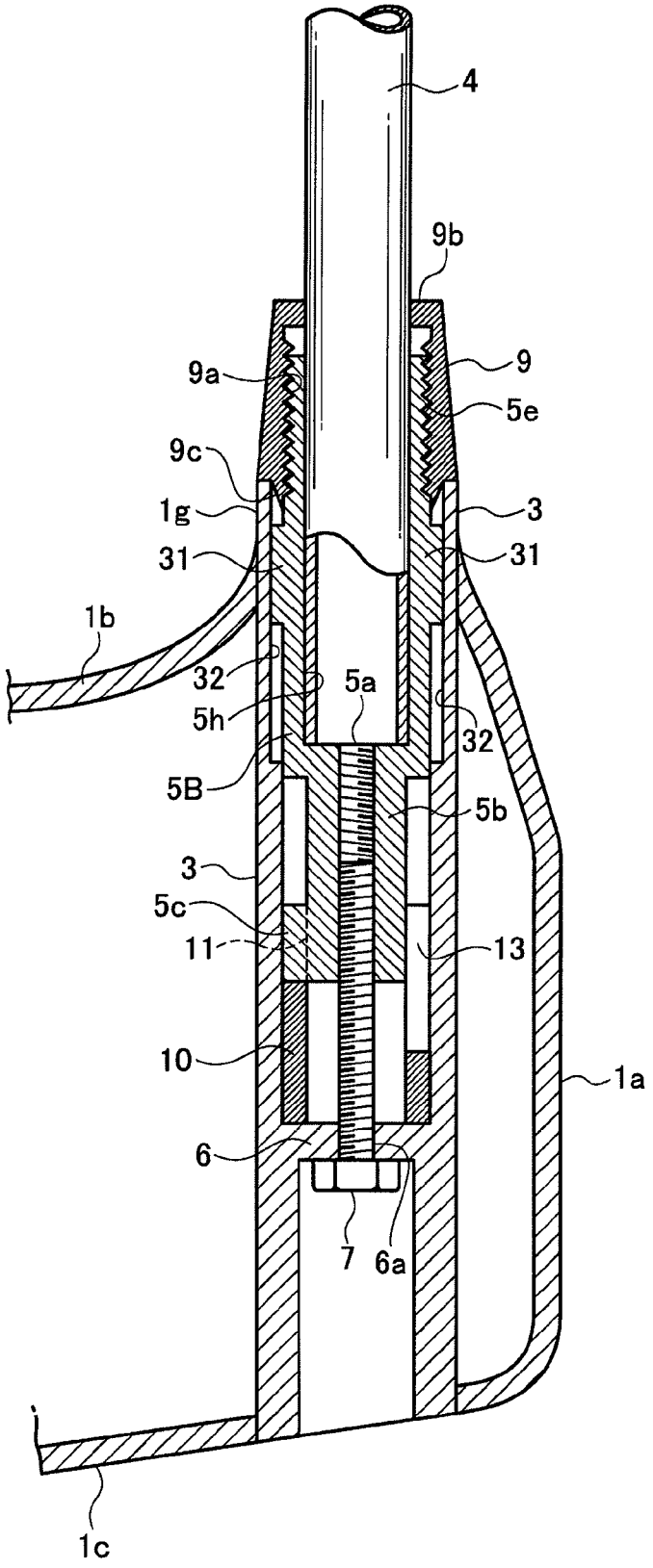
FIG. 11 is a section view of the hosel neighboring portion of a head according to a third embodiment of the invention.
Figure 12:
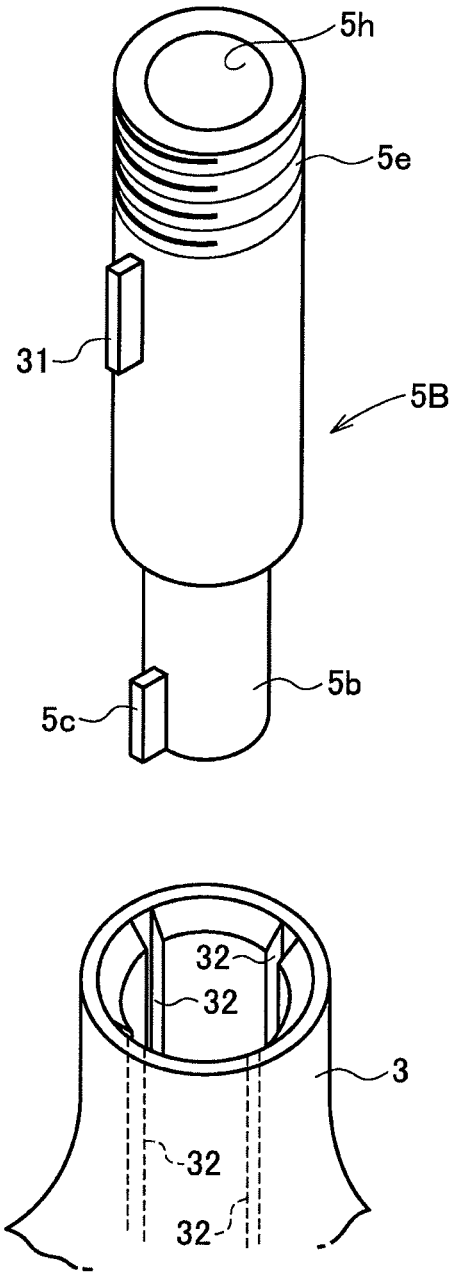
FIG. 12 is a perspective view of the hosel and shaft case of the head shown in FIG. 11.

Embodiment in FIGS. 11 and 12

In the invention, in order to strengthen the rotation-direction engagement (enhance the torque rigidity) of the shaft case, there may be provided a device for engaging a shaft case and a hosel with each other.

FIGS. 11 and 12 respectively show a head including such engaging device. FIG. 11 is a section view of a hosel neighboring portion of the head, showing the section of the same portion as shown in FIG. 3. FIG. 12 is an exploded perspective view of a hosel and a shaft case, showing their engagement relationship.

In this embodiment, a projecting portion 31 is formed on such a portion of the outer peripheral surface of a shaft case 5B as exists downwardly of the male screw 5*e*. This projecting portion 31 is constituted of a rectangular projection extending parallel to the axial line of the shaft case 5B. In this embodiment, also on the opposite side across the axis of the shaft case 5B, there is formed a projecting portion 31. The projecting portions 31 are respectively disposed upwardly of the key portion 5*c*.

In the inner peripheral surface of the hole of the hosel 3, there are formed rectangular recessed portions 32 which extend parallel to the axis of the hosel 3 and can be engaged with the projecting portions 31. In this embodiment, there are formed four rectangular recessed portions 32 which are respectively disposed upwardly of the slits 11-14.

The projecting portion 31 and recessed portion 32 constitute the engaging device. The engagement between the projecting portion 31 and recessed 32 increases the torque rigidity of the shaft case 5B.

Figure 13:
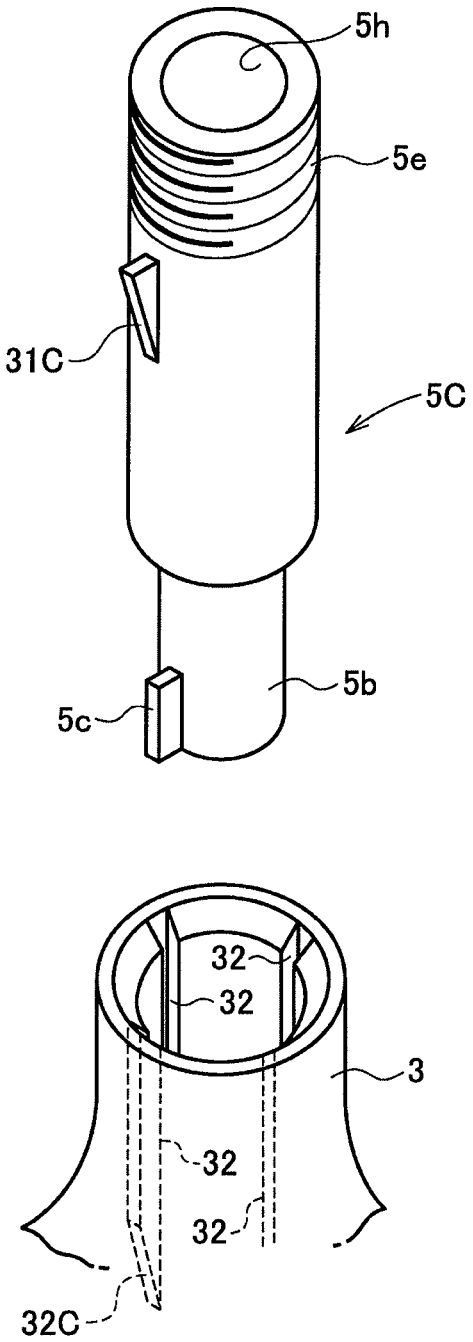
FIG. 13 is a perspective view of the hosel and shaft case of a head according to a fourth embodiment of the invention.
Figure 14:
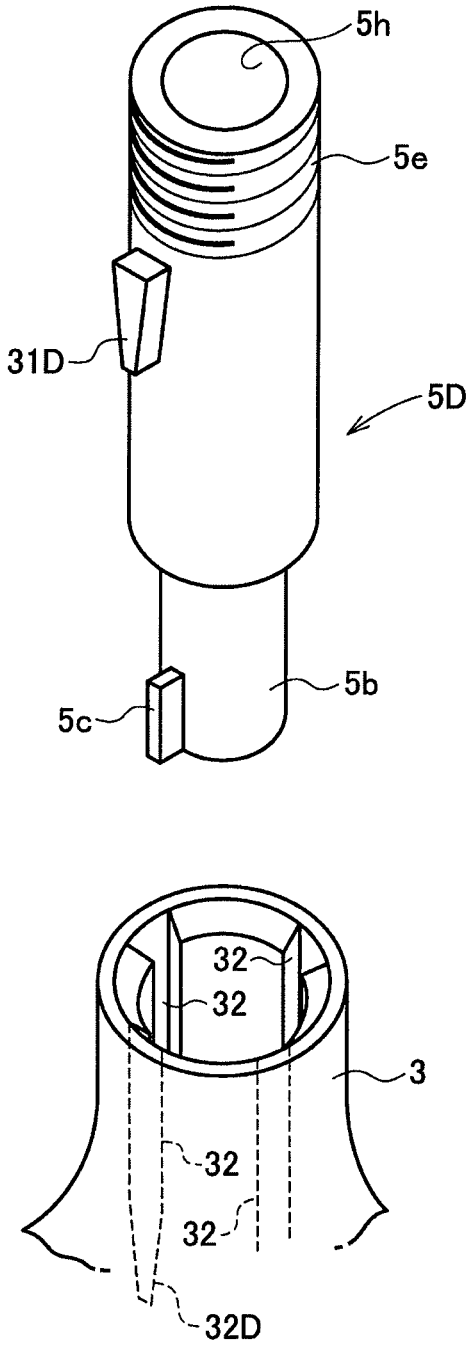
FIG. 14 is a perspective view of the hosel and shaft case of a head according to a fifth embodiment of the invention.

Embodiment in FIG. 13 & Embodiment in FIG. 14

In the embodiment in FIGS. 11 and 12, the projecting portion 31 has a square-plate-like shape and thus the projection height and peripheral direction width thereof are constant in the vertical direction. However, like a shaft case 5C shown in FIG. 13, there may also be used a shape the projection height of which decreases as it goes downward, or like a shaft case 5D shown in FIG. 14, a shape the peripheral direction width of which decreases as it goes downward.

In FIG. 13, in the lower-most section of the recessed portion 32, there is formed a slanting surface portion 32C (FIG. 13) engageable with a projecting portion 31C. In FIG. 14, in the lower-most section of the recessed portion 32, there is formed a tapered portion 32D (FIG. 14) engageable with a projecting portion 31D.

Engagement between the projecting portion 31C or 31D and recessed portion 32 through the slanting surface portion or tapered portion strengthens the fixation of the shaft case 5C or 5D, thereby reducing the shaking thereof. This makes it harder for strange sounds to be generated. Also, the firm fixation of the shaft case 50 or 5D can reduce the size of the projecting portion 31C or 31D and thus the size of the shaft case 5C, or 5D.

In the invention, preferably, a weight member may be disposed on the heel side of the head. The reason for this is as follows. That is, when the club length is increased, the swing balance of the club is changed and thus in order to provide the same balance, the weight of the head must be reduced.

Figure 10:
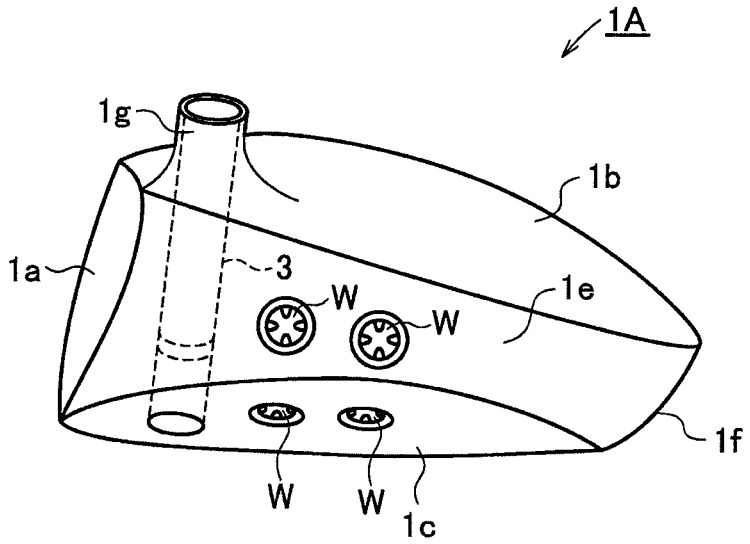
FIG. 10 is a side view of a head with a weight member mounted thereon.

FIG. 10 is a side view of an example of a head 1A with such weight member, in which two weight members W are provided on the sole portion of the heel side and two weight members W are provided on the side portion. However, the number of weight members W is not limited to this. For example, only a single weight member may also be provided. Also, the weight member may also be provided only on the sole portion or only on the side portion.

The shaft case and bolt may preferably be made of metal, especially, aluminum, titanium or their alloys.

Although the material of the head is not limited to any material, for example, a titanium alloy, an aluminum alloy, or stainless steel can be used.

In the above embodiments, the golf club head is of a wood type. However, the invention can also be applied to any type of golf club head such as a utility type, an iron type, a putter and the like.

What is claimed is:

1. A golf club, comprising:

a shaft;

a head mounted on the leading end of the shaft; and a shaft case having a substantially cylindrical shape and fixed to the leading end of the shaft and inserted into a hosel formed in the head, the shaft case being fixed to the head by a bolt inserted from the sole side of the head, wherein the shaft case includes a small-diameter cylindrical portion on the leading end side thereof and a key portion formed on the outer peripheral surface of the small-diameter cylindrical portion, and multiple slits having different depths and engageable with the key portion are formed in the deep portion of the inside of the hosel, whereby, by changing the slits engageable with the key portion, the insertion depth of the shaft case into the hosel can be changed.

2. The golf club according to claim 1, wherein a spacer having the slits is disposed in the deep portion of the inside of the hosel.

3. The golf club according to claim 2, wherein a ferrule is threadedly mounted on the upper end of the shaft case.

4. The golf club according to claim 3, wherein:

the ferrule includes on the inner peripheral edge of the lower end thereof an annular projecting portion having an outside diameter decreasing as it goes downward; and the inner peripheral edge of the upper portion of the hosel has a tapered shape engageable with the annular projecting portion.

5. The golf club according to claim 1, wherein a ferrule is threadedly mounted on the upper end of the shaft case.

6. The golf club according to claim 5, wherein:

the ferrule includes on the inner peripheral edge of the lower end thereof an annular projecting portion having an outside diameter decreasing as it goes downward; and the inner peripheral edge of the upper portion of the hosel has a tapered shape engageable with the annular projecting portion.

* * * * *